US010680375B2

(12) United States Patent
Li et al.

(10) Patent No.: US 10,680,375 B2
(45) Date of Patent: Jun. 9, 2020

(54) CONNECTION TERMINAL AND ELECTRICAL CONNECTOR

(71) Applicant: Tyco Electronics (Shanghai) Co. Ltd., Shanghai (CN)

(72) Inventors: Chaofan Li, Shanghai (CN); Hongbo Zhang, Shanghai (CN); Yongjia Wang, Shanghai (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 0 days.

(21) Appl. No.: 15/642,747

(22) Filed: Jul. 6, 2017

(65) Prior Publication Data

US 2018/0013225 A1 Jan. 11, 2018

(30) Foreign Application Priority Data

Jul. 6, 2016 (CN) ..... 2016 2 0704244 U

(51) Int. Cl.
*H01R 13/41* (2006.01)
*H01R 4/02* (2006.01)
(Continued)

(52) U.S. Cl.
CPC ..... *H01R 13/41* (2013.01); *H01R 4/029* (2013.01); *H01R 12/58* (2013.01); *H01R 24/28* (2013.01); *H01R 13/04* (2013.01); *H01R 2105/00* (2013.01)

(58) Field of Classification Search
CPC ..... H01R 13/41; H01R 13/04; H01R 13/02; H01R 13/10; H01R 13/055; H01R 13/057; H01R 13/112; H01R 13/113; H01R 13/114; H01R 13/193; H01R 13/20; H01R 13/213; H01R 13/26; H01R 13/422; H01R 13/424
See application file for complete search history.

(56) References Cited

U.S. PATENT DOCUMENTS 6,152,782 A * 11/2000 Volkert ..... H01R 13/41 439/733.1
6,478,600 B1 * 11/2002 Wang ..... H01R 13/193 439/342
(Continued)

FOREIGN PATENT DOCUMENTS

CN 201601282 U 10/2010
CN 102099971 A 6/2011
(Continued)

OTHER PUBLICATIONS

Extended European Search Report, European Patent Application No. 17178737.7, dated Sep. 26, 2017, 9 pages.
(Continued)

*Primary Examiner* — Edwin A. Leon
*Assistant Examiner* — Matthew T Dzierzynski
(74) *Attorney, Agent, or Firm* — Barley Snyder

(57) ABSTRACT

A connection terminal is provided and includes a body, a welding pin, a first stop, a second stop, and a third stop. The body includes a pair of planar surfaces and a pair of side surfaces. The welding pin extends from an end of the body. The first stop extends outwardly from one of the pair of side surfaces, while the second stop extends outwardly from another of the pair of side surfaces. The third stop protrudes outwardly from one of pair of planar surfaces.

26 Claims, 7 Drawing Sheets

(51) Int. Cl.

| | |
|---|---|
| ***H01R 12/58*** | (2011.01) |
| ***H01R 24/28*** | (2011.01) |
| ***H01R 13/04*** | (2006.01) |
| ***H01R 105/00*** | (2006.01) |

(56) References Cited

U.S. PATENT DOCUMENTS

| | | | | |
|---|---|---|---|---|
| 7,021,975 | B2 * | 4/2006 | Lappohn | H01R 13/41 439/733.1 |
| 7,086,912 | B2 * | 8/2006 | Matsuura | H01R 13/113 439/845 |
| 7,448,918 | B2 * | 11/2008 | Lappoehn | H01R 13/41 439/660 |
| 8,523,613 | B2 * | 9/2013 | Pan | H01R 13/41 439/607.07 |
| 8,708,757 | B2 * | 4/2014 | Trout | H01R 4/028 439/733.1 |
| 8,904,633 | B2 * | 12/2014 | Blossfeld | H01R 23/7073 29/884 |
| 9,172,166 | B2 * | 10/2015 | Kida | H01R 13/41 |
| 9,502,816 | B2 * | 11/2016 | Hashimoto | H01R 13/41 |
| 9,559,468 | B2 * | 1/2017 | Gailus | H01R 13/26 |
| 9,620,877 | B2 * | 4/2017 | Yao | H01R 13/05 |
| 9,711,897 | B2 * | 7/2017 | Ho | H01R 13/631 |
| 2004/0180582 | A1 | 9/2004 | Nakamura | |
| 2005/0277341 | A1 * | 12/2005 | Noguchi | H01R 13/41 439/884 |
| 2010/0041266 | A1 * | 2/2010 | Data | H01R 13/629 439/358 |
| 2011/0117795 | A1 | 5/2011 | Sakamoto | |
| 2015/0111437 | A1 | 4/2015 | Hashimoto et al. | |
| 2017/0358876 | A1 * | 12/2017 | Smith, Jr. | H01R 12/585 |

FOREIGN PATENT DOCUMENTS

| | | | |
|---|---|---|---|
| CN | 202217808 | U | 5/2012 |
| CN | 202585846 | U | 12/2012 |
| CN | 103594831 | A | 2/2014 |
| CN | 203774503 | U | 8/2014 |
| EP | 1605549 | A1 | 12/2005 |
| JP | 2007-141480 | A | 6/2007 |
| WO | 2009077819 | A1 | 6/2009 |

OTHER PUBLICATIONS

Abstract of JP 2007-141480A, dated Jun. 7, 2007, 1 page.
Abstract of CN 202585846U, dated Dec. 5, 2012, 1 page.
Abstract of CN 203774503U, dated Aug. 13, 2014, 1 page.
Abstract of CN202217808U, dated May 9, 2012, 1 page.
Abstract of CN103594831A, dated Feb. 19, 2014, 1 page.

* cited by examiner

CONNECTION TERMINAL AND ELECTRICAL CONNECTOR

CROSS-REFERENCE TO RELATED APPLICATION

This application claims the benefit of the filing date under 35 U.S.C. § 119(a)(d) of Chinese Patent Application No. CN201620704244.2 filed on Jul. 6, 2016.

FIELD OF THE INVENTION

The present invention relates to a connection terminal and, more particularly, to an electrical connector having a connection terminal for electrically connecting to an electronic component.

BACKGROUND

RAST connectors based on regular distance connection plug technology are widely used in household appliances, automobiles and industrial control systems for electrical connection between electronic components, such as wires and circuit boards. In the male connector of the existing RAST connector, a connection terminal is inserted into a plastic housing in a conventional clearance fit manner, and a holding force is provided by the barbs on both sides of the connection terminal for holding the connection terminal in the plastic housing. However, during usage of the connector, the holding force for the connection terminal is still insufficient such that the connection terminal is easy to be disengaged from the insulation housing.

SUMMARY

A connection terminal is provided and includes a body, a welding pin, a first stop, a second stop, and a third stop. The body includes a pair of planar surfaces and a pair of side surfaces. The welding pin extends from an end of the body. The first stop extends outwardly from one of the pair of side surfaces, while the second stop extends outwardly from another of the pair of side surfaces. The third stop protrudes outwardly from one of pair of planar surfaces.

BRIEF DESCRIPTION OF THE DRAWINGS

The above and other features of the present invention will be described with reference to the accompanying drawings, in which.

DETAILED DESCRIPTION OF THE EMBODIMENT(S)

Figure 1:
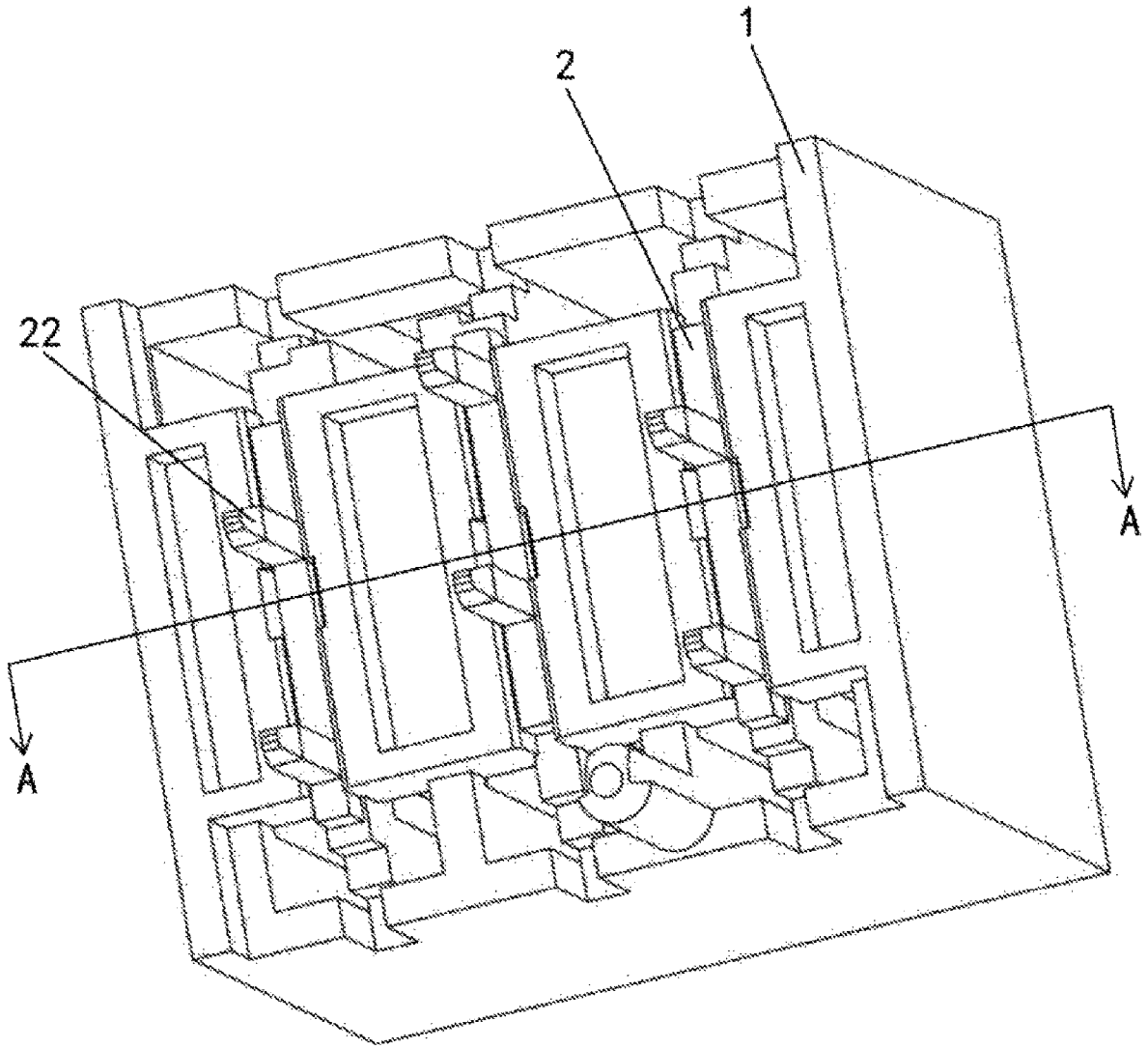
FIG. 1 is a top perspective view of an electrical connector according to an embodiment of the invention.

The present invention will be described in further detail with reference to the following embodiments, taken in conjunction with the accompanying drawings. The following description of embodiments of the present invention with reference to the accompanying drawings is intended to explain the general inventive concept of the present invention and should not be construed as limiting the present invention.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

As shown in FIG. 1, the electrical connector according to an embodiment of the invention includes an insulation housing 1 made of an insulating material such as plastic and at least one connection terminal 2 according to the invention. At least one terminal receiving space 11 is formed in the insulation housing 1, as a groove in the shown embodiment, and the connection terminals 2 are mounted in the terminal receiving spaces 11 respectively.

Referring to FIGS. 1-7, a connection terminal 2 according to an embodiment of the invention is integrally formed from a single piece of sheet made metal, such as copper, stainless steel, or the like. The connection terminal 2 may be manufactured using known machining process such as cutting, indentation, bending, stamping, and the like. The connection terminal 2 includes a flat body 21, at least one welding pin 22, at least one first stop 23, at least one second stop 24, and at least one third stop 25. The body 21 is inserted into the insulation housing 1 in a first direction (upward direction in FIG. 5) and fixed to the insulation housing 1. The welding pin 22 extends downwardly from an end of the body 21 and may be inserted into electronic components such as a circuit board, a socket, or the like, in a direction opposite to the first direction (downward direction in FIG. 5).

Figure 4:
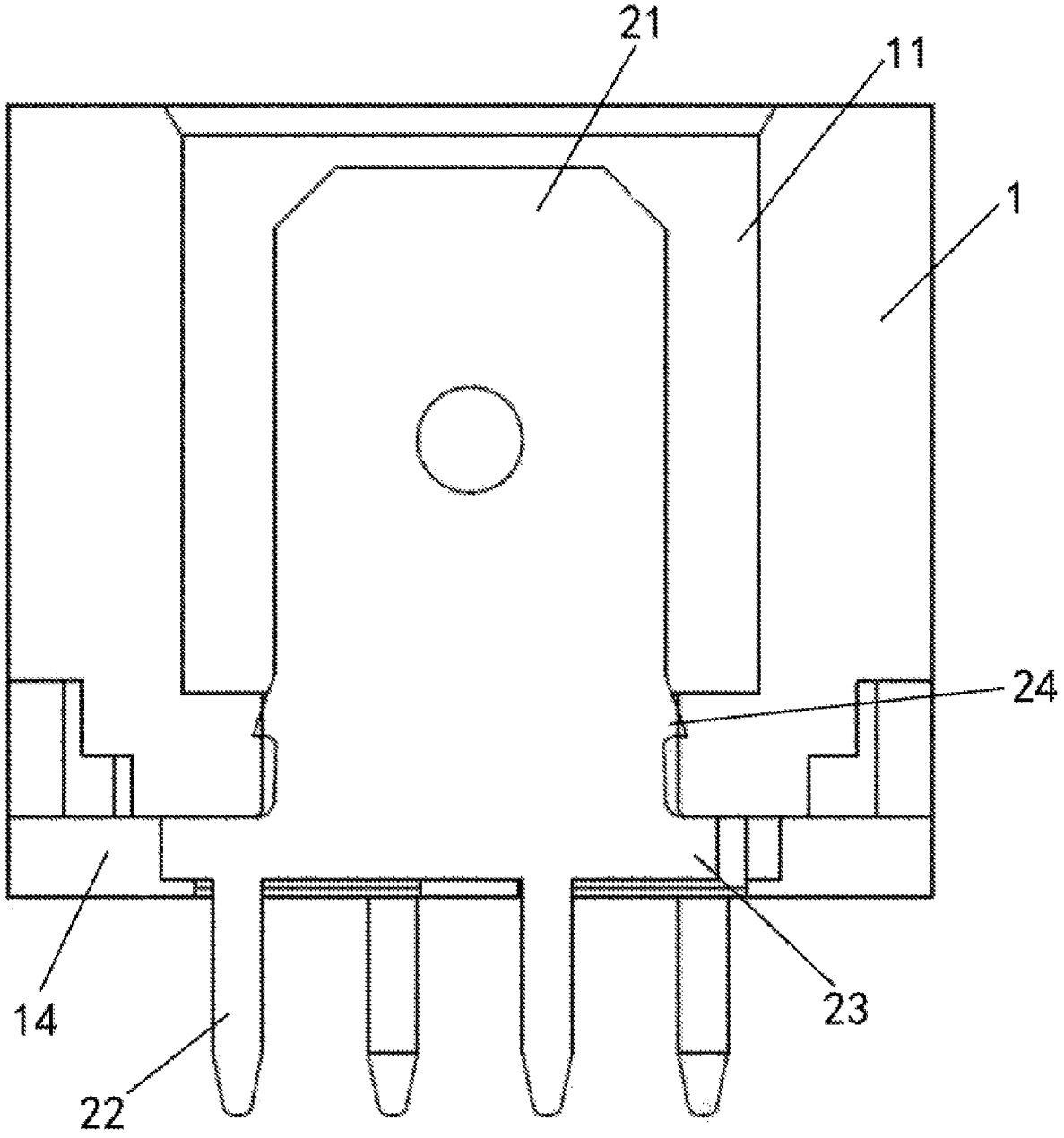
FIG. 4 is a sectional view of the electrical connector shown in FIG. 1 taken along a connection terminal according to the invention.
Figure 7:
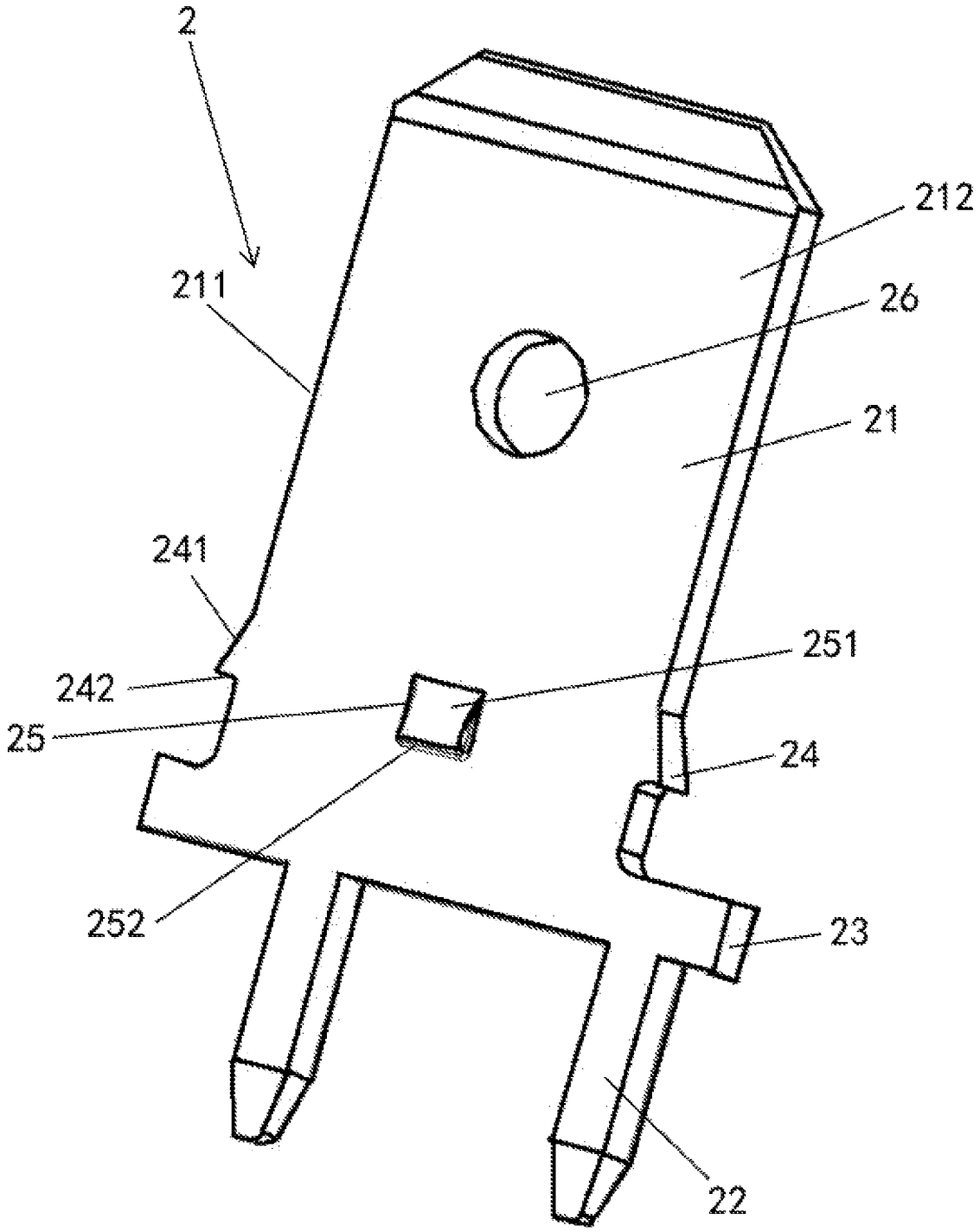
FIG. 7 is a perspective view of a connection terminal according to an embodiment of the invention.

As shown in FIGS. 4 and 7, at least one first stop 23 extends outwardly from at least one of the two side edges 211 of the body 21 (both sides are shown in the figures) such that the first stop 23 abuts against the peripheral edge of the bottom of the terminal receiving space 11. As shown in FIG. 4, when the connection terminal 2 is inserted into a proper position of the insulation housing 1, the first stop 23 abuts against a bottom of the insulation housing 2 to restrict further movement of the body 21 in a first direction, so as to prevent the welding pins 22 from entering into the insulation housing 1.

As shown in FIGS. 4 and 7, at least one second stop 24 extends outwardly from at least one of the two side edges of the body 21 (both sides are shown in the figures) to prevent the body 21 from disengaging from the insulation housing 1. Further, each second stop 24 includes a guide surface 241 inclined with respect to the side edge 211, and a blocking surface 242 positioned substantially perpendicular to the side edge 211. During the insertion of the connection terminal 2 into the insulation housing 1, the second stop 24 is guided by the guide surface 241 to slide along the side wall of the terminal receiving space 11. When the connection terminal 2 is inserted into a proper position of the insulation housing 1, the blocking surface 242 of the second stop 24 partially penetrates into the side wall of the terminal receiving space 11 to prevent the connection terminal 2 from disengaging from the insulation housing 1.

At least one third stop 25 protrudes outwardly from at least one of the two opposite surfaces of the body 21 to prevent the body 21 from disengaging from the insulating housing 1. Further, each third stops 25 includes a guide surface 251 inclined with respect to the planar surface 212 of the body 21 and a blocking surface 252 substantially perpendicular to the planar surface 212. During the insertion of the connection terminal 2 into the insulation housing 1, the third stop 25 is guided by the guide surface 251 to slide along the side wall of the terminal receiving space 11. When the connection terminal 2 is inserted into a proper position of the insulation housing 1, the blocking surface 252 of the third stop 25 partially penetrates into the side wall of the terminal receiving space 11 to prevent the connection terminal 2 from disengaging from the insulation housing 1.

In the shown embodiment, the first stop 23 is closer to the welding pin 22 than the second stop 24. In this way, it is ensured that the first stop 23 has a larger size such that the first stop 23 abuts against the bottom of the insulation housing 1 to bears against the pressure generated when the welding pin 22 is inserted into other electronic components.

In the shown embodiment, each third stops 25 is formed by punching out the planar surface 212 surface of the body 21 opposite to the third stop 25. In this way, the third stop 25 protrudes from the body 21 toward the other to increase the strength of the third stop 25 and reduce the manufacturing cost.

Figure 5:
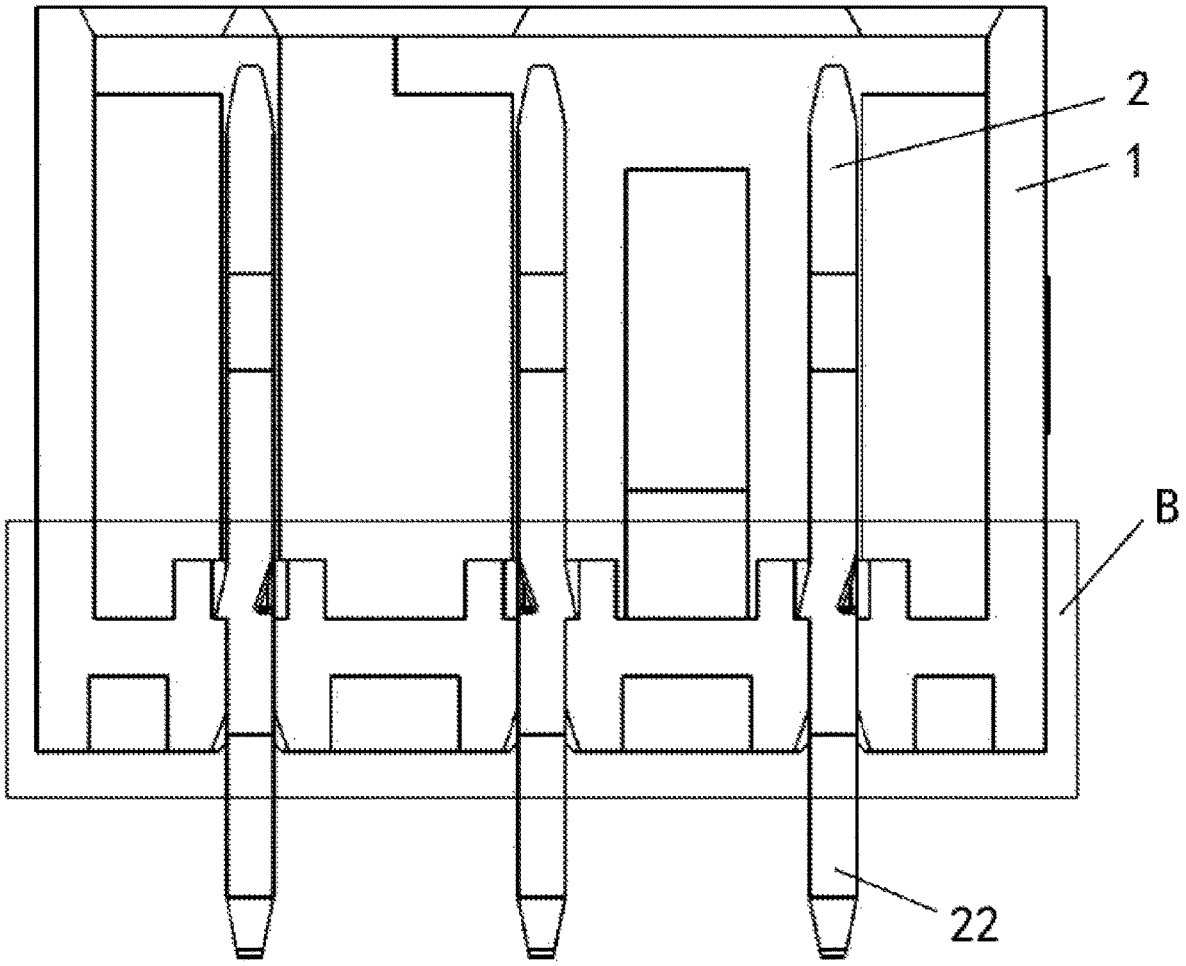
FIG. 5 is a sectional view of the electrical connector shown in FIG. 1 taken along the line A-A.
Figure 6:
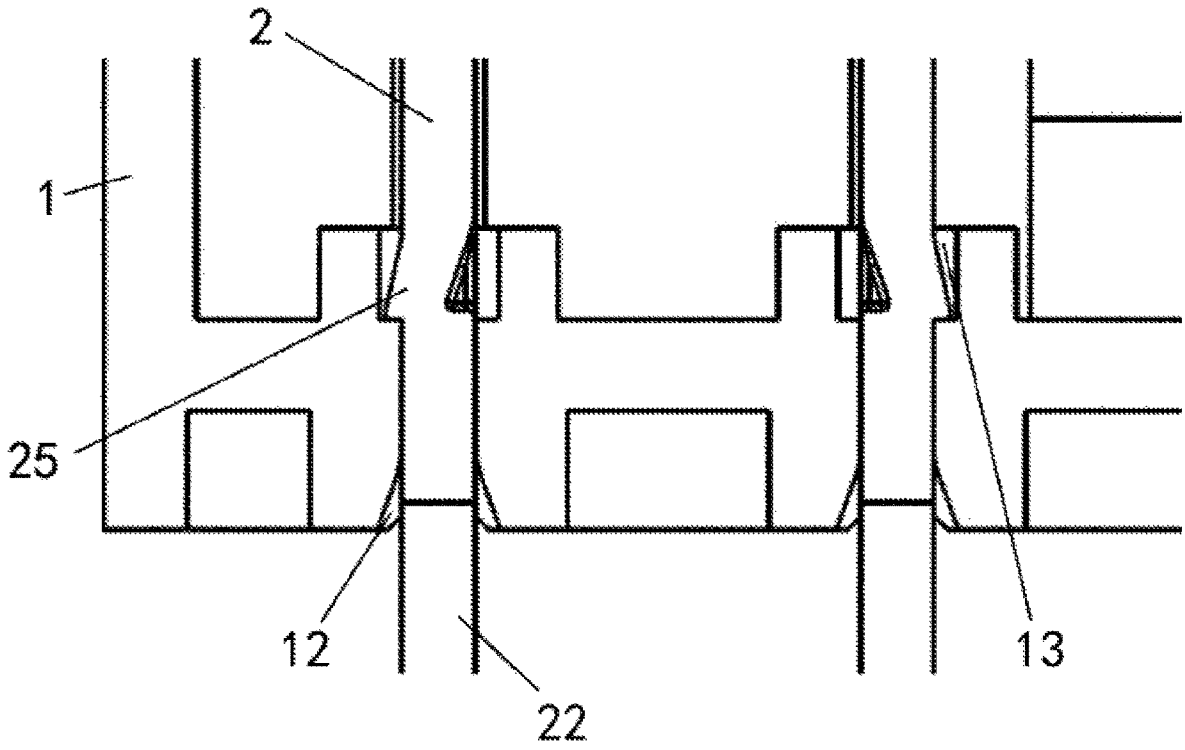
FIG. 6 is an enlarged schematic view of portion B shown in FIG. 5.

In the shown embodiment, as shown in FIGS. 1, 2, 5 and 6, each terminal receiving spaces 11 is provided with a guide groove 12 in a side wall thereof, and the third stop 25 is moved into the insulation housing 1 through the guide groove 12. Further, as shown in FIGS. 5 and 6, each terminal receiving spaces 11 is provided with a positioning groove 13 in a side wall thereof, and when the connection terminal 2 is mounted in place in the insulation housing 1, at least a part of the third stop 25 is received in the positioning groove 13. Specifically, when the connection terminal 2 is mounted in place in the insulation housing 1, the blocking surface 252 of the third stop 25 abuts against the side wall of the positioning groove 13. Thus, when the welding pin 22 of the electrical connector is pulled out of the electronic component, the connection terminal 2 may be prevented from disengaging from the insulation housing 1.

Figure 2:
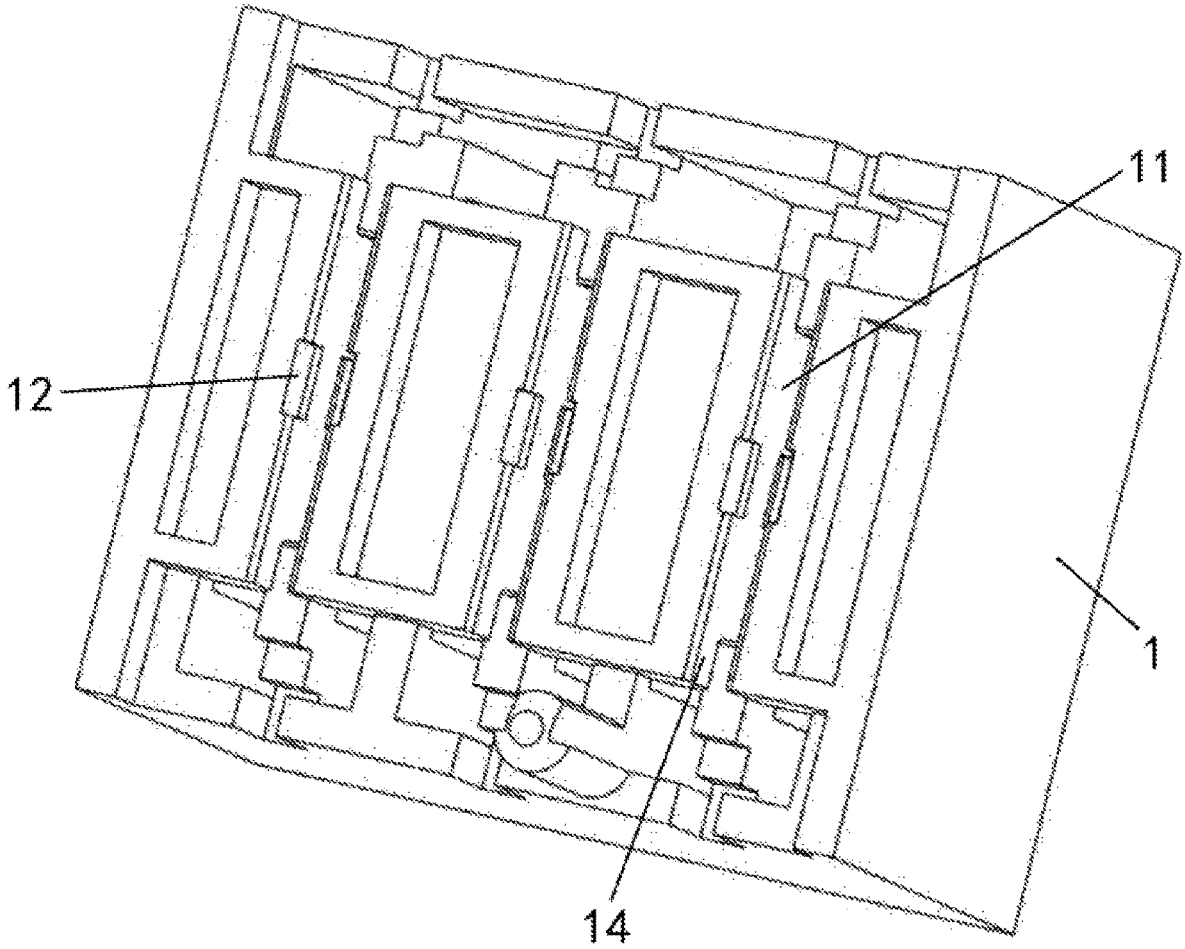
FIG. 2 is a bottom perspective view of an insulation housing of the electrical connector shown in FIG. 1.
Figure 3:
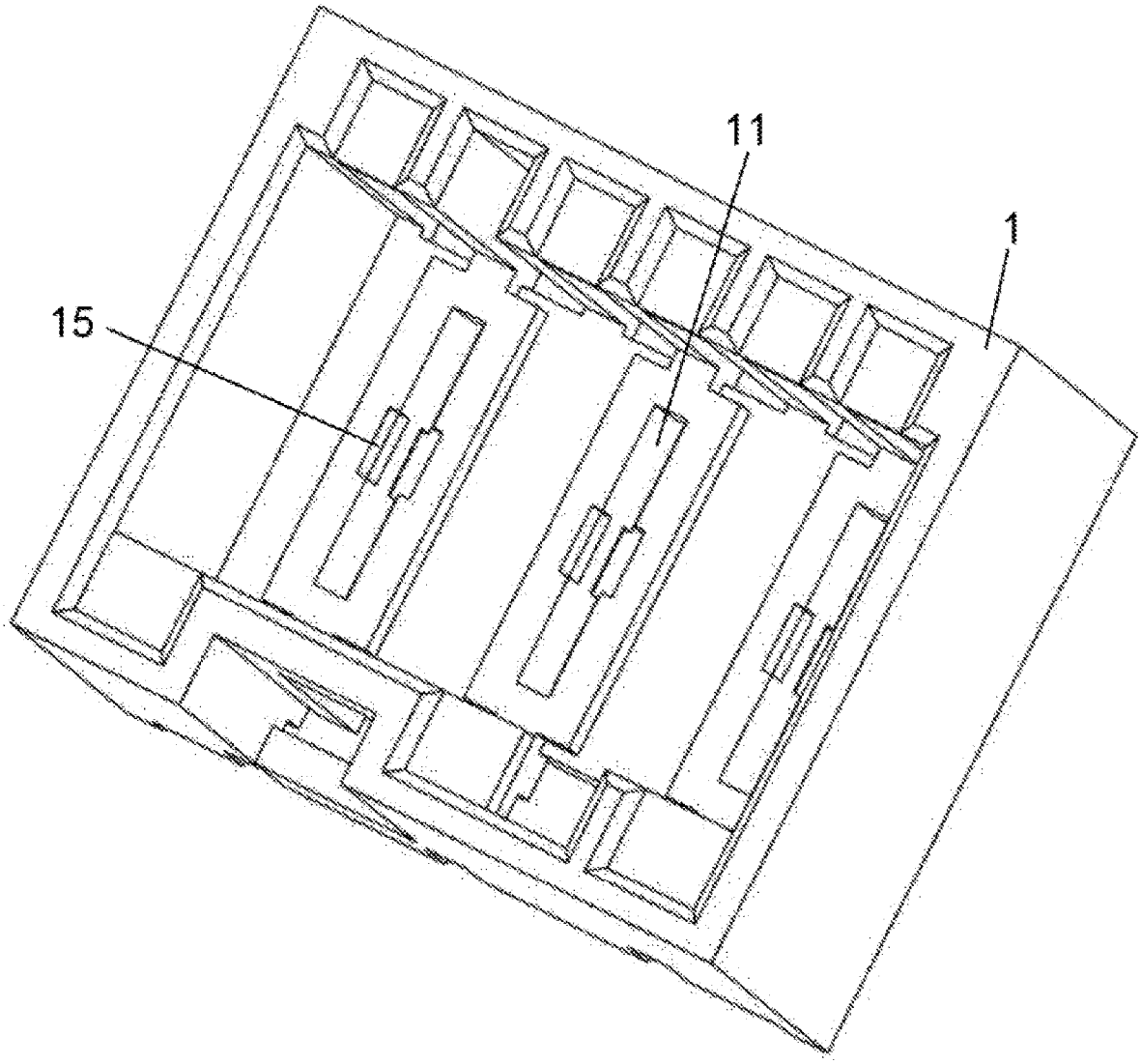
FIG. 3 is a top perspective view of the insulation housing of the electrical connector shown in FIG. 1.

In the shown embodiment, as shown in FIGS. 1, 2 and 4, at least one terminal receiving groove 14 is provided at the bottom of the insulation housing 1, and the first stop 23 abuts against the bottom of the terminal receiving groove 14. The terminal receiving groove 14 corresponds and communicates with the terminal receiving space 11. When the connection terminal 2 is mounted in place in the insulation housing 1, most of the body 21 is received in the terminal receiving space 11, and the first stop 23 abuts against the bottom of the terminal receiving groove 14, so that when the welding pin 22 is inserted into insertion holes of the electronic component, the terminal receiving groove 14 presses against the first stop 23 and prevents the pin 22 from entering the insulation housing 1.

In the shown embodiment, a surface 21 of the connection terminal 2 is in interference with the terminal receiving space 11 at a position adjacent to the bottom of the insulation housing 1 (e.g., the portion of the surface 21 between the third stop 25 and the first stop 23). Specifically, width of the lower portion of the terminal receiving space 11 is smaller than the width of the upper portion of the terminal receiving space 11 so that the lower portion of the surface of the connecting terminal 1 is clamped (i.e., friction fit in an interference manner) by the lower portion of the terminal receiving space 11. In this way, the holding force for the connection terminal 2 by the insulation housing 1 may be further improved, the surface of the connection terminal 2 may be prevented from being scratched, and external plastic chippings may be prevented from entering into the insulation housing 1.

In the shown embodiment, a connection portion 26 is provided and is formed as a hole in the body 21 of the connection terminal 2. A wire (not shown) may be connected to the connection portion 26. Correspondingly, a wire receiving space 15 is provided in the side wall of the terminal receiving space 11 to partially receive the wire.

The electrical connector provided in accordance with an embodiment of the present invention is formed as a RAST connector based on a regular distance connection plug technology and is used in household appliances, automobiles, and industrial control systems for electrical connection between electronic components such as wires and circuit boards.

It should be appreciated for those skilled in this art that the above embodiments are intended to be illustrative. Many modifications may be made to the above embodiments by those skilled in this art, and various features described in different embodiments may be freely combined with each other without conflicting in configuration or principle, to realize a variety of connection terminals 2 and electrical connectors on the basis that the technical problems of the present invention are solved.

Although several exemplary embodiments have been shown and described, it would be appreciated by those skilled in the art that various changes or modifications may be made in these embodiments without departing from the principles and spirit of the disclosure, the scope of which is defined in the claims and their equivalents. It should be noted that the terms "comprises" and/or "comprising" in this specification do not exclude other elements or steps, and the singular forms "a", "an" and "the" are intended to include the plural forms as well. In addition, any reference number in the claims should not be appreciated as limitation to the scope of the present invention.

What is claimed is:

1. A connection terminal, comprising:

a body having a pair of planar surfaces and a pair of side surfaces;

a welding pin extending from an end of the body along a length and laterally offset from the body along a surface of the body;

a first stop extending outwardly from the pair of planar surfaces and one of the pair of side surfaces and positioned proximate the end of the body and adjacent to the welding pin, the welding pin directly abutting the first stop orthogonally, in a direction opposite an insertion direction, and the welding pin is coplanar along the length with the first stop, along the pair of planar surfaces;

a second stop extending outwardly from another of the pair of side surfaces, and the second stop is coplanar with the first stop and the welding pin, along the pair of planar surfaces; and a third stop protruding outwardly from one of the pair of planar surfaces.

2. The connection terminal according to claim 1, wherein the first stop is positioned closer to the welding pin than the second stop.

3. The connection terminal according to claim 1, wherein the third stop is punched from the body.

4. The connection terminal according to claim 3, wherein the second stop includes a guide surface inclined with respect to a side edge of the body.

5. The connection terminal according to claim 4, wherein the second stop further includes a blocking surface substantially perpendicular to the side edge.

6. The connection terminal according to claim 5, wherein the third stop includes a guiding surface inclined with respect to the pair of planar surfaces.

7. The connection terminal according to claim 6, wherein the third stop further includes a blocking portion positioned substantially perpendicular to the pair of planar surfaces.

8. The connection terminal according to claim 1, wherein the first stop is orthogonal to the welding pin.

9. The connection terminal according to claim 1, wherein the first stop extends outwardly to a greater extent than the second stop extends outwardly.

10. The connection terminal according to claim 1, wherein the welding pin is laterally offset from said end of the body adjacent to the welding pin.

11. An electrical connector, comprising:

an insulation housing having a terminal receiving space extending there through; and a connection terminal comprising:

a body having a pair of planar surfaces and a pair of side surfaces;

a welding pin extending from an end of the body along a length and laterally offset from the body along a surface of the body;

a first stop extending outwardly from the pair of planar surfaces and one of the pair of side surfaces and positioned proximate the end of the body and adjacent to the welding pin, the welding pin directly abutting the first stop orthogonally, in a direction opposite an insertion direction, and the welding pin is coplanar along the length with the first stop, along the pair of planar surfaces;

a second stop extending outwardly from another of the pair of side surfaces, and the second stop is coplanar with the first stop and the welding pin, along the pair of planar surfaces; and a third stop protruding outwardly from one of the pair of planar surfaces.

12. The electrical connector according to claim 11, wherein the terminal receiving space includes a guide groove in a sidewall thereof.

13. The electrical connector according to claim 12, wherein the third stop is moved into the insulation housing through the guide groove.

14. The electrical connector according to claim 13, wherein the terminal receiving space includes a positioning groove in a side wall thereof.

15. The electrical connector according to claim 14, wherein at least a part of the third stop is received in the positioning groove.

16. The electrical connector according to claim 11, wherein the first stop abuts against the bottom of the terminal receiving space.

17. The electrical connector according to claim 11, wherein a surface of the connection terminal is in interference with the terminal receiving space adjacent to the bottom of the insulation housing.

18. The electrical connector according to claim 11, wherein the first stop is closer to the welding pin than the second stop.

19. The electrical connector according to claim 11, wherein the third stop is punched from the body.

20. The electrical connector according to claim 19, wherein the second stop includes a guide surface inclined with respect to a side edge of the body.

21. The electrical connector according to claim 20, wherein the second stop further includes a blocking surface substantially perpendicular to the side edge.

22. The electrical connector according to claim 21, wherein the third stop includes a guiding surface inclined with respect to the pair of planar surfaces.

23. The electrical connector according to claim 22, wherein the third stop further includes a blocking portion substantially positioned perpendicular to the pair of planar surfaces.

24. The electrical connector according to claim 11, wherein the first stop is orthogonal to the welding pin.

25. The electrical connector according to claim 11, wherein the first stop extends outwardly to a greater extent than the second stop extends outwardly.

26. The electrical connector according to claim 11, wherein the welding pin is laterally offset from said end of the body adjacent to the welding pin.

* * * * *